US007471906B2

(12) United States Patent
Shima

(10) Patent No.: US 7,471,906 B2
(45) Date of Patent: Dec. 30, 2008

(54) IMAGE FORMING APPARATUS AND IMAGE FORMING METHOD

(75) Inventor: Koichi Shima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 232 days.

(21) Appl. No.: 11/640,313

(22) Filed: Dec. 18, 2006

(65) Prior Publication Data

US 2007/0140713 A1 Jun. 21, 2007

(30) Foreign Application Priority Data

Dec. 21, 2005 (JP) ..... 2005-367826

(51) Int. Cl.
*G03G 15/00* (2006.01)

(52) U.S. Cl. ..... 399/26

(58) Field of Classification Search ..... 399/9, 399/24, 26, 50

See application file for complete search history.

(56) References Cited

U.S. PATENT DOCUMENTS

| | | | | |
|---|---|---|---|---|
| 7,403,723 | B2 * | 7/2008 | Moriya et al. | 399/26 |
| 7,426,351 | B2 * | 9/2008 | Yamaguchi et al. | 399/26 |

FOREIGN PATENT DOCUMENTS

| | | |
|---|---|---|
| JP | A-59-069774 | 4/1984 |
| JP | A-05-223513 | 8/1993 |
| JP | A-09-101654 | 4/1997 |
| JP | A-2001-201922 | 7/2001 |
| JP | A-2002-023464 | 1/2002 |
| JP | A-2002-108068 | 4/2002 |

* cited by examiner

*Primary Examiner*—Hoan H Tran
(74) *Attorney, Agent, or Firm*—Oliff & Berridge, PLC

(57) ABSTRACT

An image forming apparatus includes a photoconductor, an electrifying member, a high voltage applying unit for applying to the electrifying member a high voltage in which a DC component of a constant voltage on an AC component of a constant current are superposed, a DC current measuring unit for measuring a DC current value flowing from the electrifying member to the photoconductor when the photoconductor is electrified, and a controller for integrating the DC current value measured by the DC current measuring unit for an application time of the DC component to the photoconductor, calculating an electrostatic charge quantity of a DC current flowing into an electrostatic capacitance unit constituting the AC generator and subtracting the electrostatic charge quantity from the integration result to calculate the electrified charge quantity corresponding to the film thickness of the photoconductive thin film.

8 Claims, 7 Drawing Sheets

FIG. 4A

| MEASURED TEMPERATURE T | CORRECTION FACTOR α |
|---|---|
| T1-T2 | α1 |
| T2-T3 | α2 |
| ⋮ | ⋮ |
| Tn-Tn + 1 | αn |

33a

FIG. 4B

| DC VOLTAGE VALUE Vd | CORRECTION FACTOR β |
|---|---|
| Vd1-Vd2 | β1 |
| Vd2-Vd3 | β2 |
| ⋮ | ⋮ |
| Vn-Vn + 1 | βn |

33b

IMAGE FORMING APPARATUS AND IMAGE FORMING METHOD

BACKGROUND (1) Technical Field

The present invention relates to an image forming apparatus having a mechanism for applying an AC component and a DC component to a photoconductor by a contact or proximate electrification system using discharge as an electrifying principle to uniformly electrify the photoconductor, and particularly to a technique of measuring the film thickness of the photoconductor.

(2) Related Art

Various kinds of members (for example, an electrifying roller, a developing brush, a transfer roller, a cleaning brush, a cleaning blade, etc.) are disposed on the surface of a photoconductor mounted in an image forming apparatus while brought into physical contact with the surface of the photoconductor. Therefore, the photoconductive layer formed on the surface of the photoconductor repeats the physical contact with the above members every time an image forming operation is carried out, and thus the surface of the photoconductive layer wears gradually. Particularly, the rubbing force of the cleaning brush or the cleaning blade is strong, and it is a great factor causing abrasion of the photoconductive layer.

When the thickness of the photoconductive layer is reduced by some degree or more due to such abrasion, the photosensitivity is remarkably weakened or the electrification characteristic is degraded, so that it is impossible to uniformly electrify the surface to a desired potential or it is impossible to form a clear image. Therefore, it is required to measure the thickness of the photoconductive layer of the photoconductor and inform the lifetime of the photoconductor to users.

SUMMARY

According to an aspect of the present invention, there is provided an image forming apparatus including: a photoconductor that is rotationally driven and has a photoconductive thin film formed on the surface thereof; an electrifying member that is disposed in contact with or in proximity to the photoconductor and electrifies the photoconductive thin film; a high voltage applying unit that applies to the electrifying member a high voltage achieved by superposing a DC component of a constant voltage generated from a DC generator on an AC component of a constant current generated from an AC generator; a DC current measuring unit that measures a DC current value flowing from the electrifying member to the photoconductor when the photoconductor is electrified; and a controller that integrates the DC current value measured by the DC current measuring unit for a time during which the DC component is applied to the photoconductor, calculating an electrostatic charge quantity of a DC current flowing into an electrostatic capacitance unit constituting the AC generator and subtracting the electrostatic charge quantity from the integration result to calculate the electrified charge quantity corresponding to the film thickness of the photoconductive thin film.

BRIEF DESCRIPTION OF THE DRAWINGS

Exemplary embodiments of the invention will be described in detail based on the following figures, wherein:

FIGS. 4A and 4B are diagrams showing a rectification rate setting table used in the exemplary embodiment;

DETAILED DESCRIPTION

(1) Construction of Image Forming Apparatus 1

Figure 1:
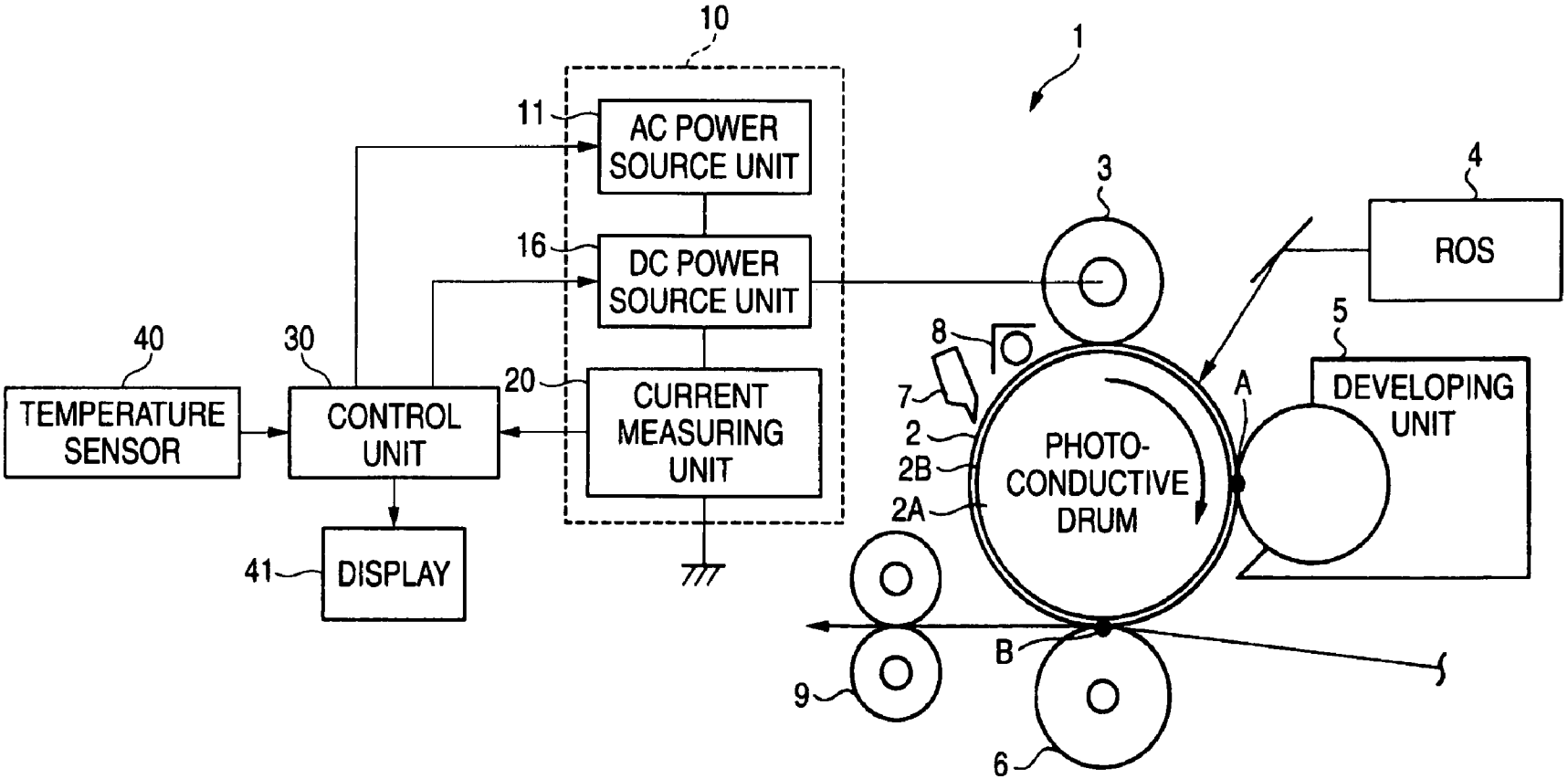
FIG. 1 is a diagram showing an image forming apparatus according to an exemplary embodiment of the invention.

The construction of an image forming apparatus 1 according to the present invention will be described with reference to FIG. 1.

An electrifying roller 3, ROS 4, a developing unit 5, a transfer roller 6, a cleaning blade 7, a statically eliminating lamp 8, etc. are disposed around a photoconductive drum 2 mounted in the image forming apparatus.

The photoconductive drum 2 is equipped with an electrically conductive drum board 2A, and a photoconductive thin film 2B having OPC (organic photoconductor for electrophotography) formed on the surface of the drum board 2A. The photoconductor drum 2 is rotated at a predetermined process speed (peripheral velocity) in a clockwise direction indicated by an arrow around the center axial line.

The electrifying roller (BCR: Bias Charging Roller) 3 serves as an electrifying member in contact with the photoconductive drum 2. The electrifying roller 3 is rotationally driven in connection with the rotation of the photoconductive drum 2, and a high voltage supplied from a power supply device 10 described later is applied thereon, whereby the surface of the photoconductive drum 2 is uniformly electrified to a predetermined polarity/potential (electrified negatively in this exemplary embodiment).

ROS (Raster Optical Scanner; image writing unit) 4 irradiates an image-modulated laser beam to the electrification-treated surface of the photoconductive drum 2 (the electrification-treated surface is exposed to the laser beam while scanned). The potential of an exposed portion is attenuated and thus an electrostatic latent image is formed on the photoconductive thin film 2B. When the electrostatic latent image arrives at the developing position A facing the developing unit 5 in connection with the rotation of the photoconductive drum 2, negatively-electrified toner is supplied from the developing unit 5 to the electrostatic latent image, whereby a toner image is formed by inversion development.

The transfer roller 6 is located at the downstream side of the developing unit 5 with respect to the rotational direction of the photoconductive drum 2, and it is disposed so as to be in contact with the photoconductive drum 2 under pressure. The nip portion between the transfer roll 6 and the photoconductive drum 2 serves as a transfer position B.

When the toner image formed on the surface of the photoconductive drum 2 reaches the transfer position B in connection with the rotation of the photoconductive drum 2, a sheet is supplied to the transfer position B in synchronism with the timing at which the toner image reaches the transfer position B. In addition, a predetermined voltage is applied to the transfer roll 6, and the toner image is transferred from the surface of the photoconductive drum 2 to the sheet.

The sheet to which the toner image is transferred at the transfer position B is transported to a fixing unit 9 to fix the toner image onto the sheet, and then the sheet is discharged to the outside of the apparatus.

The non-transferred residual toner remaining on the surface of the photoconductive drum 2 is scraped off by the cleaning blade 7, whereby the surface of the photoconductive drum 2 is cleaned and set to a standby state for next image formation. Furthermore, the electrostatic latent image on the photoconductive drum 2 is erased by the erasing lamp 8.

2) Power Supply System to Electrifying Roller 3

Next, a power supply system to the electrifying roller 3 will be described.

This power supply system is equipped with the power supply device 10 including an AC power source unit 11 and a DC power source unit 16 for supplying a high voltage to the electrifying roller 3, and a current measuring unit 20, and a control unit 30 for controlling the operation of the power supply device 10.

Figure 2:
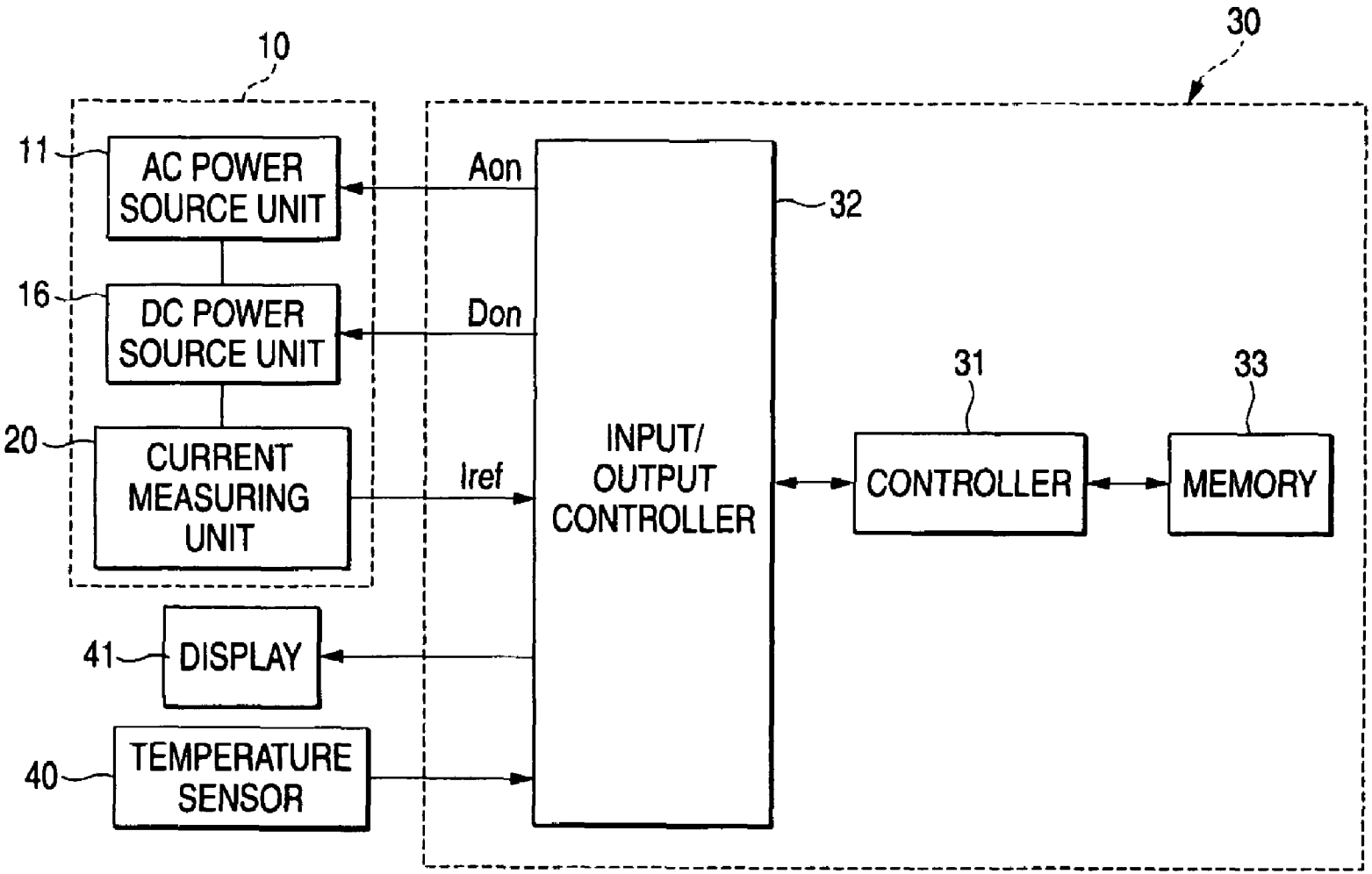
FIG. 2 is a block diagram showing the construction of the image forming apparatus according to the exemplary embodiment.

Here, as shown in the block diagram of FIG. 2, the power supply device 10 has the AC power source unit 11 for generating a voltage of AC component, and the DC power source unit 16 for generating a voltage of DC component. The constructions of the power source units 11 and 16 and the current measuring unit 20 will be described later. The current measuring unit 20 measures the measurement current Iref corresponding to the film thickness in a film thickness measuring mode.

The control unit 30 is equipped with a controller 31, an input/output controller 32, and a memory 33, and these elements are constructed by CPU (Central Processing Unit) and RAM (Random Access Memory).

The AC power source unit 11 and the DC power source unit 16 of the power supply device 10 are connected to the input/output side of the input/output controller 32. Furthermore, the current measuring unit 20 and a temperature sensor 40 are connected to the input side, and a display 41 is connected to the output side. The control unit 30 outputs an instruction signal Aon to the AC power source unit 11, and also outputs an instruction signal Don to the DC power source unit 16.

The controller 31 executes image forming processing, film thickness judging processing described later, etc. according to a control program stored in the memory 33. In the above processing, the processing of turning on/off and changing the constant current output in the AC power source unit 11 and also turning on/off and changing the constant voltage output in the DC power source unit 16 is carried out to keep uniform the electrification state in the photoconductive thin film 2B of the photoconductive drum 2 in the image forming processing. Furthermore, the film thickness judging processing is executed separately from the image forming processing. The film thickness judging processing is executed in the measurement mode under a preset condition (after a predetermined number of sheets are printed, after a predetermined time elapses, when a user's instruction is made, or the like).

A correction factor setting table 33*a* (see FIG. 4A) used for the film thickness judging processing is stored in the memory 33. The correction factor setting table 33*a* is a table for setting a correction factor for correcting variation of the electrostatic capacitance of a DC regulating capacitor 14 described later due to ambient temperature.

Furthermore, in the memory 33 is stored the threshold charge quantity Q0 corresponding to a limited value d0 of the reduced film amount serving as a judgment reference of film thickness used for the film thickness judging processing.

(3) Construction of Power Supply Device 10

Figure 3:
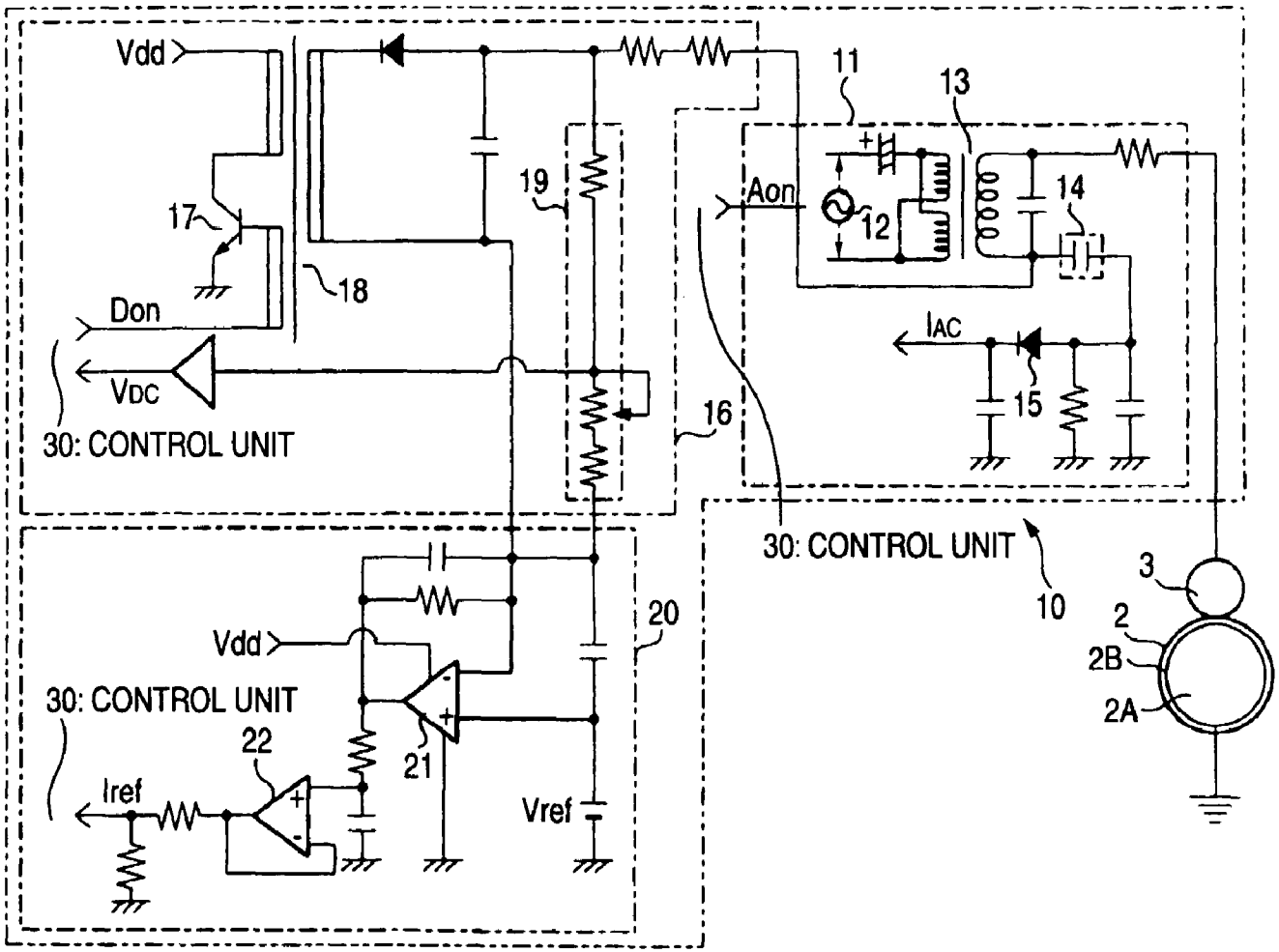
FIG. 3 is a circuit diagram showing a power supply device used in the exemplary embodiment.

Next, the construction of the power supply device 10 will be briefly described with reference to a circuit diagram of FIG. 3.

When the instruction signal Aon is received from the control unit 30 by the AC power source unit 11, an AC power drive circuit 12 is operated, an AC component boosted through a transformer 13 is generated, and one end of the secondary side of the transformer 13 is connected to the electrifying roller 3. Furthermore, an output from the DC power source unit 16 is connected to the other end of the secondary side of the transformer 13, and also a detecting diode 15 is connected through the DC regulating capacitor 14 to the other end of the secondary side of the transformer 13. The detecting diode 15 conducts half-wave rectification on the AC component of current flowing in a circuit constructed by the electrifying roller 3, the photoconductive drum 2, the ground and a detecting circuit, thereby achieving a monitor signal IAC, and feeds back the monitor signal IAC to a control section in the power supply device 10.

The DC regulating capacitor 14 prevents the current of the AC component supplied from the AC power source unit 11 from flowing into the ground side of the DC power source unit 16. Therefore, a capacitor having electrostatic capacitance C0 whose impedance is equal to about ten times of the load capacitance, for example, 2200 pF, is used. In order to prevent flow of the current of the DC component into the ground side completely, the electrostatic capacitance C0 of the DC regulating capacitor 14 may be increased. However, if it is excessively increased, the time constant when the current of the AC component is supplied is increased, and thus the response speed is lowered. Accordingly, it is the present situation that the electrostatic capacitance C0 of the DC regulating capacitor 14 is set in consideration of the situation that a slight amount of current flows to the ground side of the DC power source unit 16 through the DC regulating capacitor 14.

Upon receiving an instruction signal Don from the control unit 30, the DC power source unit 16 turns on a switching transistor 17 to apply a predetermined DC voltage Vdd (for example, 24V) to the primary side of a transformer 18, thereby generating a DC voltage (for example, −750V) which is boosted through the transformer 18. One end of the secondary side of the transformer 18 is connected to the other end (low potential side) of the secondary side of the transformer 13 of the AC power source unit 11 to superpose the DC component on the AC component. A voltage dividing resistor 19 and the DC measuring unit 20 are connected to the output side of the DC power source unit 16 in series, and a monitor signal VDC which is generated by picking up a voltage at some midpoint of the voltage dividing resistor 19 is fed back to the control section in the power supply device 10.

The current measuring unit 20 is connected to the low potential side of the DC power source unit 16, and it constitutes a differential circuit having, as basic parts, operational amplifiers 21 and 22 actuated by the predetermined voltage Vdd. The ground of the current measuring unit 20 is common to the ground of the photoconductive drum 2, and thus the current flowing in the photoconductive thin film 2B of the photoconductive drum 2 through the electrifying roller 3 flows into the current measuring unit 20, and the current corresponding to the circuit constant (impedance) of the current measuring unit 20 is measured as measured current Iref.

The measured current Iref measured by the current measuring unit 20 is output to the control unit 30.

The AC component of the voltage supplied to the electrifying roller 3 and the photoconductive drum 2 forms a closed circuit with the AC power source unit 11 through the ground of the photoconductive drum 2, and the DC component of the voltage concerned forms a closed circuit with the DC power source unit 16 and the AC power source unit 11 through the ground of the photoconductive drum 2 and the current measuring unit 20.

(4) Measurement Result

Next, the actual measurement result will be described with reference to FIGS. 5, 6A and 6B.

Figure 5:
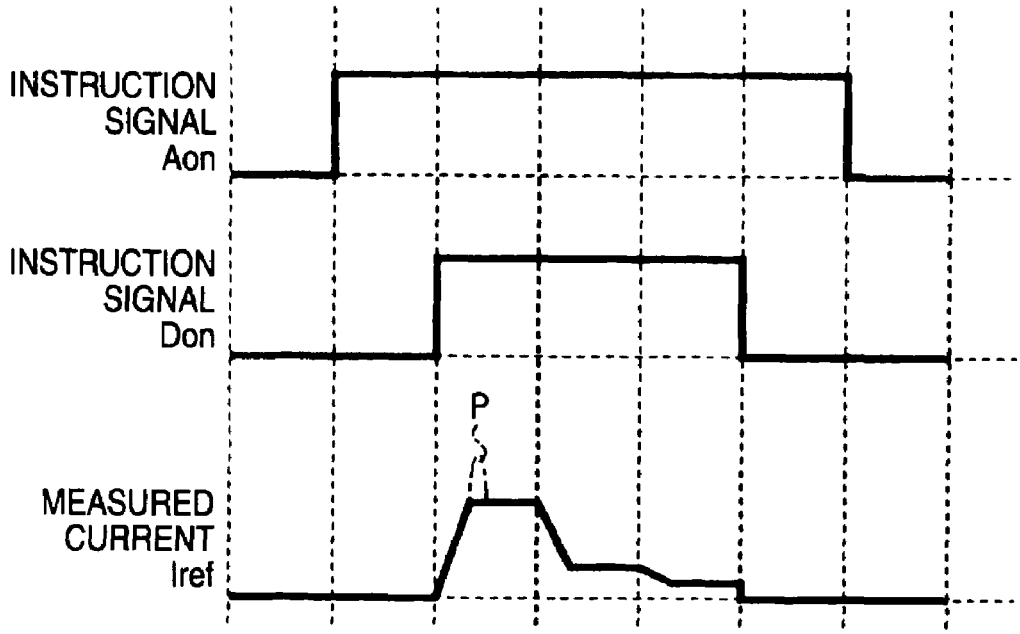
FIG. 5 is a diagram showing the waveform of each part in a film thickness judgment processing according to the exemplary embodiment.

FIG. 5 is a graph showing the instruction signals Aon and Don and the measured current Iref in the measurement mode with respect to the time axis. One grid on the abscissa axis represents the time in which the photoconductive drum 2 rotates by 360° (hereinafter referred to "one rotation"). As a matter of convenience of description, the following description will be made by describing "electricity" as "current".

First, the control unit 30 supplies the instruction signal Aon to the Ac power source unit 11, and the current of the AC component is supplied from the AC power source unit 11 through the electrifying roller 3 to the photoconductive drum 2 during the time corresponding to five rotations. The ground of the photoconductive drum 2 is common to the ground of the AC power source unit 11, and thus a closed circuit is formed by the secondary side of the transformer 13, the electrifying roller 3 and the photoconductive drum 2 (see FIG. 3).

Next, when the photoconductive drum 2 is about to make a second circuit after the current of the AC component is supplied, the control unit 30 supplies the instruction signal Don to the DC power supply unit 16, and the current of the DC component is supplied from the DC power supply unit 16 through the electrifying roller 3 to the photoconductive drum 2 during the term corresponding to three rotations. The ground of the photoconductive drum 2 is common to the ground of the DC power source unit 16, and thus a closed circuit is formed by he secondary side of the transformer 18, the electrifying roller 3, the photoconductive drum 2 and the current measuring unit 20 (see FIG. 3). The high voltage achieved by superposing the DC component on the AC component generated in advance is supplied to the photoconductive drum 2 by the closed circuit concerned.

The current in which the DC component is superposed on the AC component is successively supplied to the photoconductive drum 2 at the position where the electrifying roller 3 comes into sliding contact with the photoconductive drum 2, whereby electrifying the charges on the photoconductive thin film 2B. The reason why the current in which the DC component is superposed on the AC component is used resides in that charges are accumulated in a material having a dielectric constant near to insulator.

The waveform of the measured current Iref will be described with reference to FIG. 5. The current measuring unit 20 does not start to operate until the current of the DC component is supplied thereto. In the first rotation of the photoconductive drum 2 during which the photoconductive drum 2 is supplied with the current of the DC component, the current value rises up to the current value corresponding to the DC voltage by the influence of the time constant of the circuit, however, it has not yet been saturated. The current value concerned is equal to the value of current flowing into the photoconductive thin film 2B. In the second and third rotations of the photoconductive drum 2, current whose amount corresponds to the remaining capacity of the unsaturated photoconductive thin film 2B flows into the photoconductive thin film 2B.

Then, the area of the measured current Iref during these three rotations (corresponding to the time for which the current of the DC component is supplied) is integrally calculated to determine the quantity Q of charges electrified on the photoconductive thin film 2B.

Figure 6A:
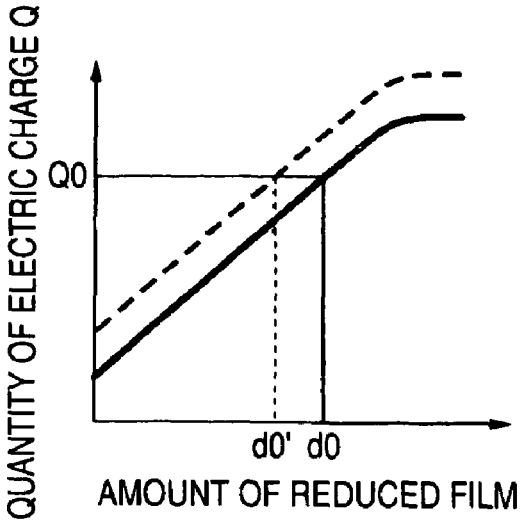
FIGS. 6A and 6B are characteristic diagrams showing the charge quantity and the resistance value of a photoconductive thin film with respect to the amount of reduced film in the exemplary embodiment.

FIG. 6A shows the characteristic of the charge quantity Q of the photoconductive thin film 2B corresponding to the reduced film amount of the photoconductive thin film 2B. As the reduced film amount is increased (that is, the film thickness is reduced), the charge quality Q is increased, and when the film thickness of the photoconductive thin film 2B reaches the abrasion limit, it is found that the electrification limit has come. Furthermore, FIG. 6B is a diagram showing the characteristic of the resistance value R of the photoconductive thin film 2B corresponding to the reduced film amount of the photoconductive thin film 2B. The characteristic of the resistance value R has is inversely proportional to the charge quantity Q, and thus the resistance value R is reduced as the film thickness is reduced.

Here, the DC regulating capacitor 14 is used to prevent the current of the DC component from flowing into the ground side. However, when the current of the DC component is supplied, a potential difference occurs in the DC regulating capacitor 14 and current flows through the DC regulating capacitor 14 in a moment, so that overshoot P occurs in the measured current Iref as shown in FIG. 5.

Figure 6B:
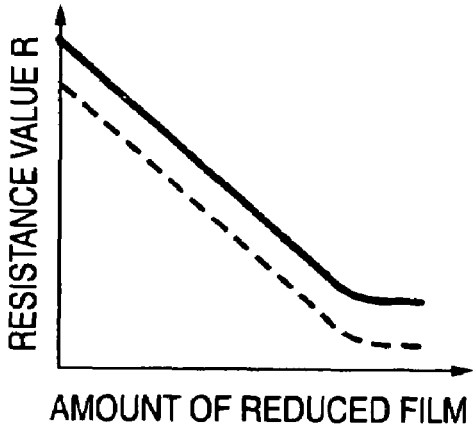

The overshoot P causes the characteristic line as indicated by dotted lines of FIGS. 6A and 6B to become an actually measured value. For example, when the limit value of the reduced film amount of the photoconductive drum 2 is represented by d0, the charge quantity corresponding to d0 becomes a threshold charge quantity Q0. If no overshoot P occurs, an instruction of exchanging the photoconductive drum 2 may be informed at the stage that the calculated charge quantity Q exceeds the threshold charge quantity Q0. However, if some overshoot P occurs, a value larger than the actual charge quantity Q is calculated, and thus an instruction of exchanging the photoconductive drum is output at d0'at which the reduced film amount does not reach the limit value. Accordingly, it is impossible to accurately inform the exchange timing of the photoconductive drum 2.

(5) Operation of this Exemplary Embodiment

Figure 7:
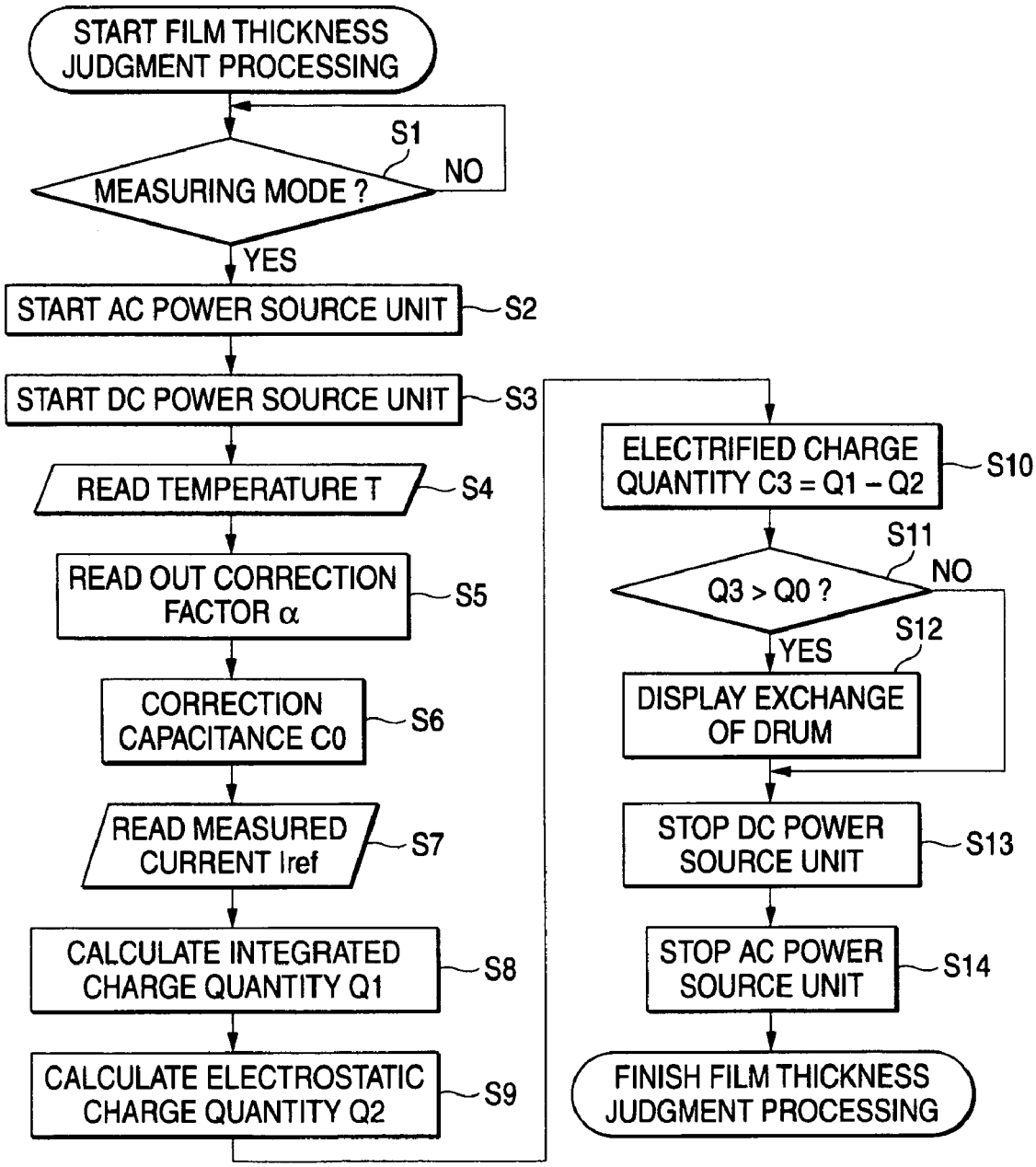
FIG. 7 is a flowchart showing the film thickness judgment processing according to the exemplary embodiment.
Figure 8:
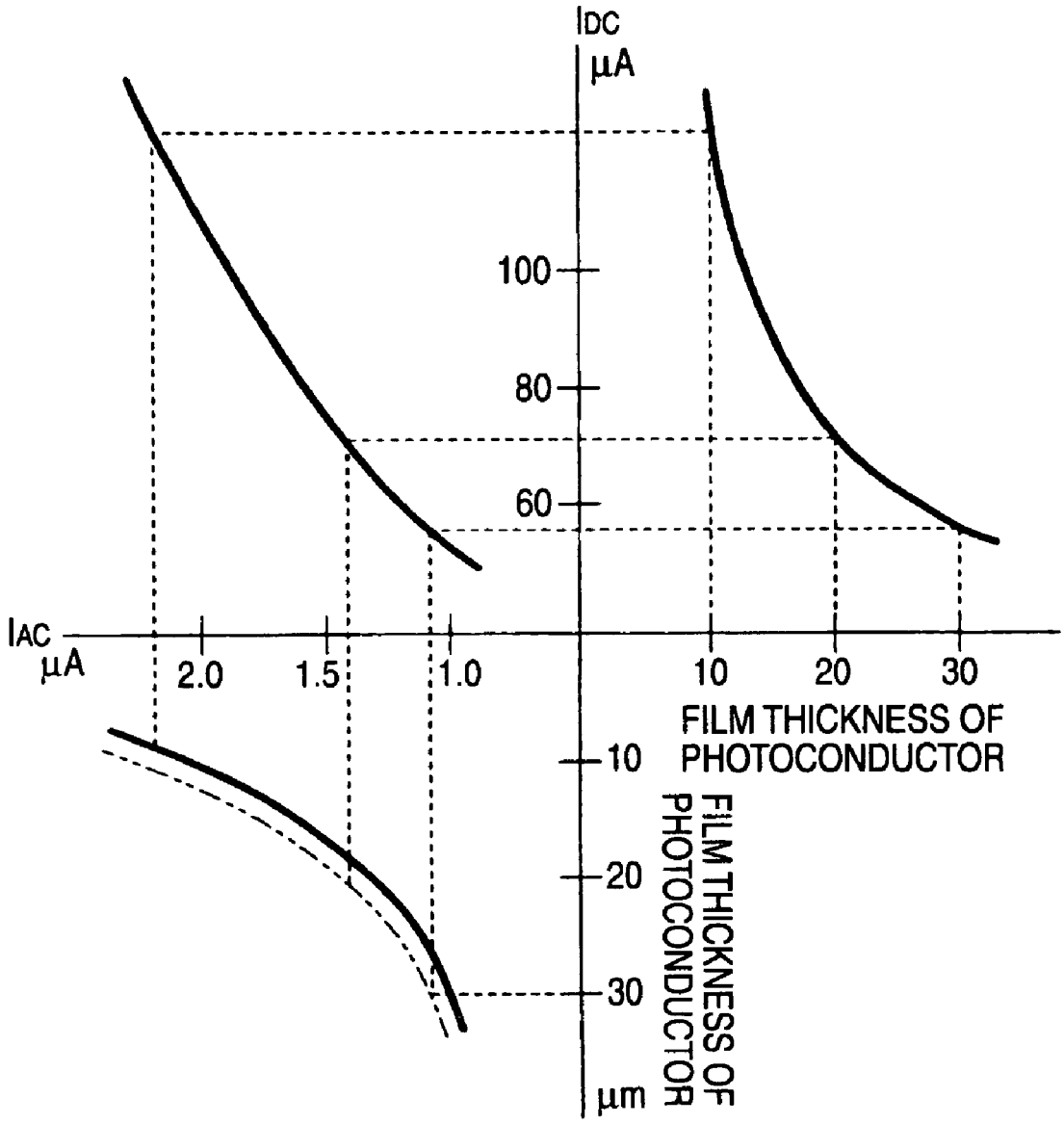
FIG. 8 RELATED ART
FIG. 8 is a diagram showing a related art.

Next, the measuring operation of the film thickness will be described with reference to the flowchart of FIG. 7.

The control unit 30 judges whether the present mode is a film thickness measuring mode or not (step S1). Through this judgment processing, the control unit 30 is on standby until the film thickness measuring mode is set.

When the film thickness measuring mode is set (step S1; YES), the control unit 30 outputs the instruction signal Aon to the AC power source unit 11 (step S2). The AC power source unit 11 receiving the instruction signal Aon supplies the current of the AC component to the electrifying roller 3.

Furthermore, the control unit 30 outputs the instruction signal Don to the DC power source unit 16 after the photosensitive drum 2 rotates once (step S3). The DC power source unit 16 receiving this instruction signal Don supplies the current of the DC component to the electrifying roller 3.

Accordingly, as described above the current in which the DC component is superposed on the AC component is successively supplied to the photoconductive drum 2 at the position where the electrifying roller 3 comes into sliding contact with the photoconductive drum 2, thereby electrifying charges on the photoconductive thin film 2B.

Subsequently, the control unit 30 reads the temperature T from the temperature sensor 40 to correct the electrostatic capacitance C0 of the DC regulating capacitor 14 (step S4), and reads the correction factor α by referring to a correction factor setting table 33*a* from the read temperature T (step S5). Thereafter, the control unit 30 corrects the electrostatic capacitance C0 of the DC regulating capacitor 14 on the basis of the read-out correction factor α (step S6).

The control unit 30 measures the measured current Iref from the current measuring unit 20 while the current of the DC component is supplied, and achieves a waveform as shown in FIG. 5 (step S7). The control unit 30 integrates the measured current Iref for the time for which the current of the DC component is supplied (three rotations), and calculates an integrated charge quantity Q1 (step S8). The control unit 30 calculates the electrostatic charge quantity Q2 corresponding to the electrostatic capacitance C0 of the corrected DC regulating capacitor 14 (step S9). Then, the control unit 30 subtracts the electrostatic charge quantity Q2 from the calculated integrated charge quantity Q1 to calculate the electrified charge quantity Q3 (step S10).

Subsequently, the control unit 30 judges whether the electrified charge quantity Q3 exceeds the threshold charge quantity Q0 (step S11). In this judgment processing, if Q3≦Q0 (step S11; NO), the photosensitive thin film 2B does not reach the limit value of the reduced film amount (the limited film thickness), and thus the processing goes to step S13.

On the other hand, if Q3>Q0 (step S11; YES), the photosensitive thin film 2B reaches the limit value of the reduce film amount (the limited film thickness), and thus an instructing of requesting "exchange of photoconductive drum" is displayed on the display 41 (step S12).

Furthermore, the control unit 30 stops the output of the instruction signal Don to the DC power source unit 16 (step S13), and also stops the output of the instruction signal Aon to the AC power source unit 11 (step S14), thereby finishing the film thickness judgment processing.

In this processing, with respect to the reading time of the measured current Iref of the step S7 and the stop of the power source units 16 and 11 of the steps S13 and 14, the processing corresponding to time lapse (the operation of the photoconductive drum 2) is separately needed. However, in order to make easy the understanding of the operation of this processing, it is shown in one flowchart.

For example, in the above exemplary embodiments, the electrostatic capacitance C0 of the DC regulating capacitor 14 is corrected on the basis of the temperature. However, according to this invention, the electrostatic capacitance C0 may be set to a given fixed value or may be corrected on the basis of the DC voltage. When the electrostatic capacitance C0 is corrected on the basis of the DC voltage, the correction factor setting table 33*b* shown in FIG. 4B may be used. Furthermore, the correction based on the DC voltage may be carried out in combination with the correction based on the temperature. In place of the correction factor setting table, a correction factor conversion equation may be stored in the memory 33, and the correction factor may be converted in accordance with the temperature or the DC voltage. Furthermore, in the above exemplary embodiments, the electrifying roller is used as an electrifying member for electrifying the photoconductive drum 2. However, other types of electrifying members than the roller type may be used. Furthermore, the electrifying member may electrify the photoconductive drum 2 while being in contact with or in proximity to the surface of the photoconductive drum 2.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a photoconductor that is rotationally driven and has a photoconductive thin film formed on the surface thereof;

an electrifying member that is disposed in contact with or in proximity to the photoconductor and electrifies the photoconductive thin film;

a high voltage applying unit that applies to the electrifying member a high voltage achieved by superposing a DC component of a constant voltage generated from a DC generator on an AC component of a constant current generated from an AC generator;

a DC current measuring unit that measures a DC current value flowing from the electrifying member to the photoconductor when the photoconductor is electrified; and a controller that integrates the DC current value measured by the DC current measuring unit for a time during which the DC component is applied to the photoconductor, calculating an electrostatic charge quantity of a DC current flowing into an electrostatic capacitance unit constituting the AC generator and subtracting the electrostatic charge quantity from the integration result to calculate the electrified charge quantity corresponding to the film thickness of the photoconductive thin film.

2. The image forming apparatus according to claim 1, wherein the controller stores the electrostatic capacitance of the electrostatic capacitance unit as a given capacitance value, and calculates the electrostatic charge quantity of the DC current component flowing into the electrostatic capacitance unit based on the given capacitance value.

3. The image forming apparatus according to claim 1, further comprising a temperature measuring unit that measures the temperature in the image forming apparatus, wherein the controller stores a temperature characteristic of the electrostatic capacitance unit with respect to temperature, calculates an electrostatic capacitance value based on the temperature characteristic from the temperature measured by the temperature measuring unit and calculates the electrostatic charge quantity of the DC current component flowing into the electrostatic capacitance unit by using the electrostatic capacitance value.

4. The image forming apparatus according to claim 1, wherein the controller stores a DC voltage value characteristic of the electrostatic capacitance unit with respect to a DC voltage value, calculates an electrostatic capacitance value based on the DC voltage generated from the DC generator and calculates the electrostatic charge quantity of the DC current component flowing into the electrostatic capacitance unit by using the electrostatic capacitance value.

5. The image forming apparatus according to claim 1, wherein the controller has an informing unit that informs that the photoconductive thin film reaches a use limit when the calculated charge quantity of the photoconductive thin film exceeds to a predetermined charge quantity corresponding to a predetermined film thickness.

6. The image forming apparatus according to claim 1, wherein the photoconductor is a photoconductive drum, and the electrifying member is an electrifying roller that is provided in contact with or in proximity to the surface of the photoconductive drum and driven in connection with the rotation of the photoconductive drum.

7. An image forming method using an image forming apparatus including; a photoconductor that is rotationally driven and has a photoconductive thin film formed on the surface thereof; an electrifying member that is disposed in contact with or in proximity to the photoconductor and electrifies the photoconductive thin film; a high voltage applying unit that applies to the electrifying member a high voltage achieved by superposing a DC component of a constant voltage generated from a DC generator on an AC component of a constant current generated from an AC generator; a DC current measuring unit that measures a DC current value flowing from the electrifying member to the photoconductor when the photoconductor is electrified; the image forming method comprising:

integrating the DC current value measuredly the DC current measuring unit for a time during which the DC component is applied to the photoconductor;

calculating an electrostatic charge quantity of a DC current flowing into an electrostatic capacitance unit constituting the AC generator; and subtracting the electrostatic charge quantity from the integration result to calculate the electrified charge quantity corresponding to the film thickness of the photoconductive thin film.

8. The image forming method according to claim 7, further including calculating the electrostatic charge quantity of the DC current component flowing into the electrostatic capacitance unit based on the electrostatic capacitance of the electrostatic capacitance.

* * * * *